United States Patent [19]

Robinson

[11] 4,014,459

[45] Mar. 29, 1977

[54] CONTAINER CLOSURE

[75] Inventor: Ronald L. Robinson, Stow, Ohio

[73] Assignee: Go-Jo Industries, Inc., Akron, Ohio

[22] Filed: Oct. 8, 1975

[21] Appl. No.: 620,563

[52] U.S. Cl. ..... 220/380; 220/356; 206/508; 220/306

[51] Int. Cl.[2] ..... B65D 55/00; B65D 43/08; B65D 41/18

[58] Field of Search ..... 220/306, 352, 355, 356, 220/380; 206/508, 509

[56] References Cited

UNITED STATES PATENTS

| | | | |
|---|---|---|---|
| 2,812,121 | 11/1957 | Sheets | 220/306 X |
| 2,913,140 | 11/1959 | Vuillemenot | 220/306 |
| 3,307,739 | 3/1967 | Cloyd et al. | 206/508 |
| 3,805,994 | 4/1974 | Cherry et al. | 220/306 |

*Primary Examiner*—William Price
*Assistant Examiner*—Steven M. Pollard
*Attorney, Agent, or Firm*—Perry Reese Taylor

[57] ABSTRACT

A unique container closure is disclosed which includes a flat top surface, a vertical side wall, and a sloping intermediate wall interconnecting the top and the side wall at an angle to the vertical. Interiorly of the closure are depending, radially inwardly extending reinforcement ribs which are integrally connected to the top surface, the intermediate wall, and the side wall for stiffening purposes. An annular depending rib is also contained on the interior surface of the intermediate wall, and the inner surface of the side wall has a recess, an inwardly extending annular flange, and a further recess adapted to engage a corresponding lip on the container per se. In this fashion the depending flange of the intermediate wall and the internal rib of the side wall will firmly engage the top lip of the container per se, while the unique intermediate wall construction between the side wall and the top surface will prevent inadvertent dislodgment of the lid by coming into contact with the lid of an adjacent container.

1 Claim, 6 Drawing Figures

CONTAINER CLOSURE

BACKGROUND OF THE INVENTION

This invention relates, in general, to closure members for containers and, in particular, relates to an improved closure member intended to be snapped onto the top of a generally cylindrical container.

DESCRIPTION OF THE PRIOR ART

The following patent prior art is known to Applicant:

| | |
|---|---|
| Klygis | U.S. Patent 3,216,610 |
| Allen | U.S. Patent 3,223,278 |
| Ritter | U.S. Patent 3,355,061 |
| Johnson | U.S. Patent 3,417,897 |
| Bardell | U.S. Patent 3,519,163 |
| Churan | U.S. Patent 3,804,289 |
| Cherry et al | U.S. Patent 3,805,994 |

The foregoing patents disclose varying types of snap-type closure members for containers for various purposes. A variety of different configurations are known, but none disclose a container closure having an external surface which makes it virtually impossible for the closure member to be dislodged accidentally. The prior art generally teaches cup-shaped closures which have flat top surfaces and vertical side walls which engage the top of the container.

In this general field containers of this nature are packed and shipped in cardboard cartons in varying numbers. The difficulty is that during shipment the cardboard carton itself is subject to deformation for a number of reasons. When this happens, one or more of the containers will move out of the plane in which the remaining containers are located. At that time with conventional closure members, the lower lip or edge of the vertical side wall has a tendency to engage the top surface of an adjacent closure, and further shifting has a tendency to dislodge the top closure member, thereby permitting spillage, waste, etc. The present invention is believed to obviate this difficulty.

Most conventional closure members of this general type also present a storage problem. Specifically, most of these lids have a stacking ring, and once they have been stacked and stored for any appreciable period of time, there is a tendency for the lids to spread out over the stacking ring to create a telescoping effect. The problem presented by this is that it often is desired to attach the closure member to the container by machine. If the stack of closure members is jammed together, as is possible with most of the conventional ones, machine application is very difficult to achieve, and the stack has to be separated by hand.

Additionally, especially with closure members molded from higher density materials, there is a tendency for the lids to warp during storage. Once more, when the containers are being capped by machine, the machine will not properly handle a warped closure member although it is possible, of course, to apply them to the containers by hand. However, this is much less economical.

SUMMARY OF THE INVENTION

Thus it has been found that the aforementioned disadvantages can be overcome by providing a closure member having a substantial flat top wall and a substantially vertical side wall, with the top wall having a smaller circumference than the area enclosed by the side wall. In this fashion the top wall and side wall can be interconnected by a sloping intermediate wall so that no substantial horizontal surfaces are presented adjacent the periphery whereby the vertical wall of an adjacent closure could contact it and become inadvertently dislodged.

It has also been found that improved locking can be provided by means of depending reinforcing ribs extending radially inwardly and being formed integrally with the side, intermediate, and top walls, and a depending annular reinforcement flange provided on the inner surface of the intermediate wall whereby the bottom edge of the reinforcing ribs and the flange will contact the top surface of the rib of the container per se.

The vertical side wall of the closure member also can be provided with an inwardly extending flange for locking purposes whereby an improved secure locking arrangement can be achieved.

Furthermore, the internal reinforcing ribs provide a much more rigid closure member than is usually the case, and it has been found that this structure renders the closure much less susceptible to warping and, therefore, much more susceptible to being handled by automatic capping machines.

Additionally, it has been found that the tapered configuration of the sloping intermediate wall allows for very easy stacking, storage, and handling, both before and during production. This construction eliminates the need for the conventional stacking ring and, furthermore, prevents the lids from being jammed together during the storage period, thereby again making them much easier to handle by machine.

Accordingly, production of an improved closure member of the character above-described becomes the principal object of this invention, with other objects thereof becoming more apparent upon a reading of the following brief specification, considered and interpreted in view of the accompanying drawings.

OF THE DRAWINGS

BRIEF DESCRIPTION OF THE PREFERRED EMBODIMENT

Figure 1:
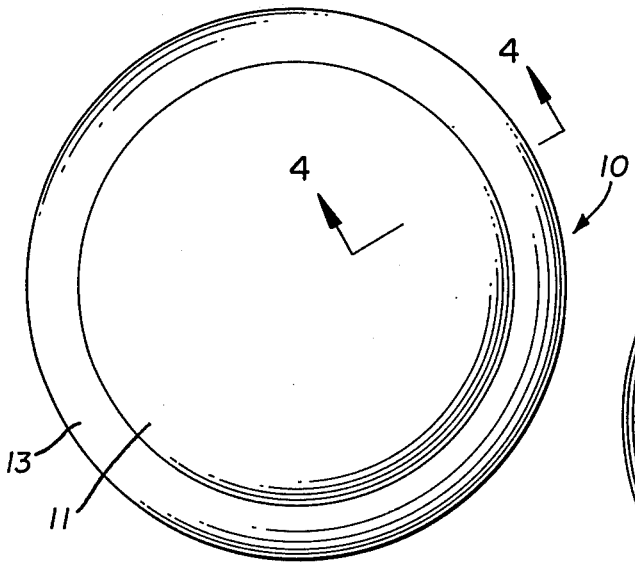
FIG. 1 is a top plan view of the improved closure.

Referring first to FIGS. 1 through 4 of the drawings, it will be noted that the improved closure member 10 has a generally cup-shaped configuration and includes a substantially flat top wall 11, a vertical side wall 12, and an interconnecting intermediate wall 13.

It will be noted from the drawings that the circumference of the top wall 11 is considerably less than the circumference formed by the side wall 12 so that, in effect, the periphery of the top wall is offset inwardly from the periphery of the side wall. Intermediate wall 13, therefore, interconnects the top wall 11 and side wall 12 in a sloping configuration or at an angle to the vertical.

Figure 5:
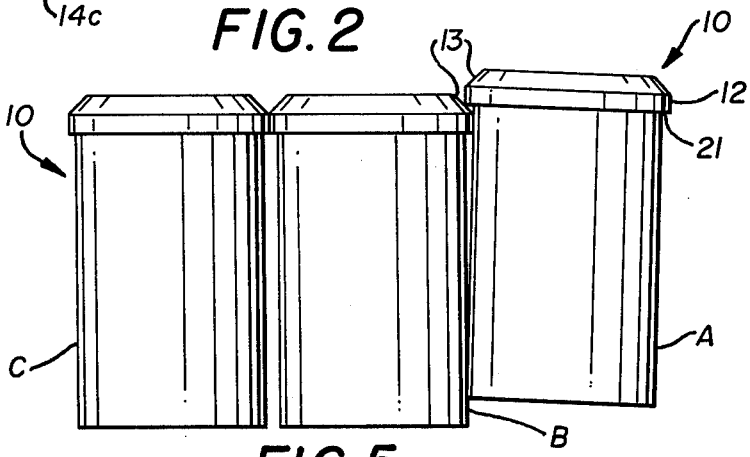
FIG. 5 is an elevational view showing a plurality of closure members of the present invention disposed in close proximity to each other.

As will be noted from FIG. 5, this prevents accidental dislodgment of the closure 10 because even if adjacent containers shift out of alignment, the bottom edge of the side wall 12 will contact the sloping intermediate wall 13 and simply slide off it. Were that surface horizontal, as is conventional, it would serve as a lever to pry the lid 10 off the container.

Figure 3:
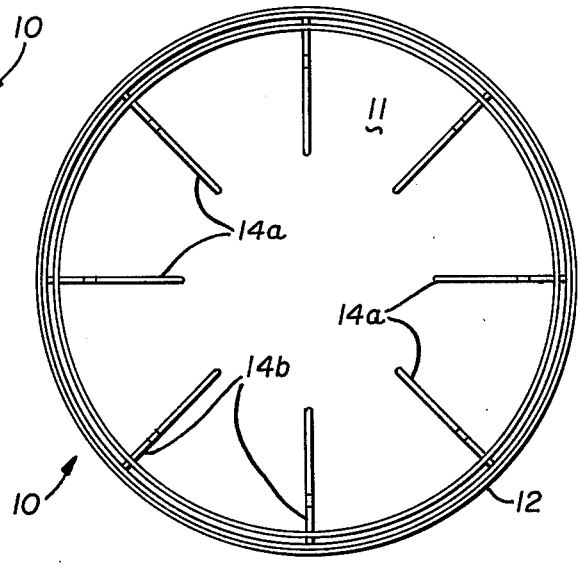
FIG. 3 is a bottom plan view of the improved closure member.
Figure 2:
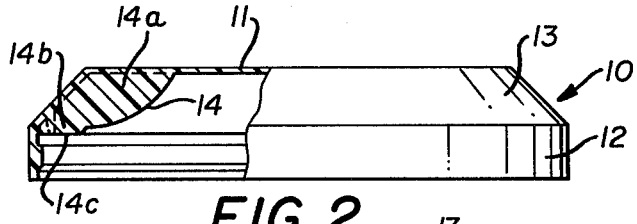
FIG. 2 is a side elevational view of the improved closure partially broken away in section.
Figure 4:
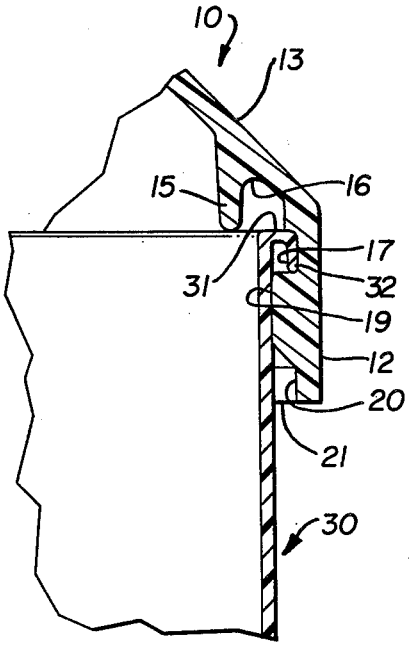
FIG. 4 is a partial sectional view taken along the line 4—4 of FIG. 1 showing the closure member in place on the container.

Referring then to FIGS. 2 through 4 for a further description of the interior of the closure member, it will be noted that a plurality of radially inwardly extending reinforcements 14,14 are provided, with these reinforcements preferably being molded so as to be integral with top wall 11, side wall 12, and intermediate wall 13.

It will be noted that these ribs have an upper body portion 14*a* and a lower body portion 14*b*. The lower edge of upper body portion 14*a* is arcuate and joins the inner edge of lower portion 14*b* to form a substantially horizontal seat. The inner edge of lower portion 14*b* then tapers to a point at which it joins lower edge 14*a* for purposes which will be described below.

Also disposed interiorly of the closure is an annular vertically depending flange 15 which depends from the inner surface of the intermediate wall 13. A recess 16 is thus provided between the flange and the side wall 12.

A peripheral groove 17 is also provided in vertical side wall 12, and an inwardly extending rib 19 is also provided in the side wall which tapers away then to a recessed area 20 for purposes which will now be described.

Accordingly, and referring to FIG. 4 of the drawings, it will be noted that the container 30 has an outwardly extending rib 31 on its top edge terminating in a return flange 32. As will be noted from FIG. 4, utilizing this type of container together with the improved closure permits very secure locking between the two.

Thus it will be noted that when the closure 10 is in place on the container 30, the depending annular flange 15 will be in abutment with the top of the rib 31 of the container. The return flange 32 of the container will be received in the recess 17 of the closure member, and the inwardly extending rib 19 will engage beneath the rib 31 of the container so that the rib 31 of the container is trapped between flange 15, side wall 12, and rib 19, thereby providing an extremely secure locking arrangement. Also lower edges 14*c* of reinforcements 14,14 will also contact rib 31.

As noted above and as illustrated in FIG. 5, a construction such as is presently being disclosed not only provides this very secure locking, but serves to avoid accidental dislodgment of the lids of adjacent containers. As can be seen from FIG. 5, when container A shifts so as to be above the tops of containers B and C, the lid 10 thereof, and particularly the bottom edge 21 of the side wall 12, will contact the sloping intermediate surface 13 and tend to simply slide away. In the prior art, horizontally disposed surfaces are provided in this region, and any further shifting between containers A and B, for example, would permit the lid or closure member 10 of container A to be pried off the top of the container.

Furthermore, it will be noted that the radially inwardly projecting ribs 14,14 serve to stiffen the overall closure member 10. This serves to resist any wrapping which might occur, particularly when the container is made of high density material. Therefore, provision of the internal stiffening makes it possible to assure that the closure member 10 will retain its desired configuration, thereby facilitating machine application of the closure 10 to the container 30.

Figure 6:
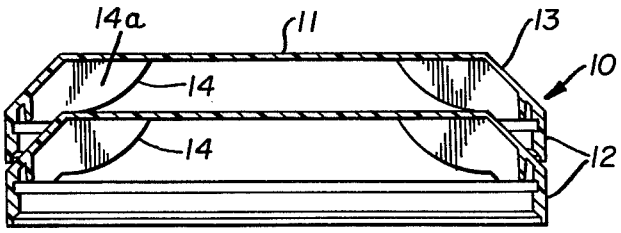
FIG. 6 is an elevational view, in section, showing two of the closure members in stacked condition.

Furthermore, it will be noted from FIG. 6 that the provision of the sloping intermediate wall 13 in combination with the internal ribs 14,14 facilitates stacking or nesting of the closure members when they are in storage. This obviates the spreading or telescoping problem of most of the prior art and also, of course, eliminates the need for a specially constructed stacking ring. It also makes the closure members of the present invention much easier to stack and much easier to handle by machine since it is virtually impossible for them to become jammed together.

It will also be noted from FIG. 6 that the edges of reinforcement ribs 14,14 are substantially complemental to the outer configuration of closure member 10, thereby further enhancing the stacking or nesting capabilities of the improved closure member. Thus the lower edges thereof are essentially complemental with the outer contours of an adjacent closure member for engagement purposes.

While a full and complete description of the invention has been set forth in accordance with the dictates of the Patent Statutes, it should be understood that modifications can be resorted to without departing from the spirit hereof or the scope of the appended claims.

Accordingly, while the closure member and the container have been described and illustrated as generally cylindrical and circular in configuration, it should be understood that similar advantages could be obtained with closure members and containers having different cross-sectional configurations.

What is claimed is:

1. A container closure for removable placement over the open end of a container body, comprising;

A. a substantially flat top portion;

B. a substantially vertical side wall portion;

C. an intermediate wall portion interconnecting said side wall portion and said top portion;

D. said top portion 1. having a circumferential dimension less than the circumferential dimension of said side wall portion, and 2. having a midpoint lying in a plane that is in substantial alignment with the midpoint of the area bounded by said side wall portion;

E. said intermediate wall portion being disposed at an angle with respect to the vertical;

F. said top portion having upper and lower planar faces; and

G. a plurality of radially inwardly extending reinforcement ribs interconnecting said side wall portion, said intermediate wall portion, and said lower planar face of said top portion; and H. said reinforcement ribs having an edge configuration complemental to the outer configuration of said top and intermediate portions.

* * * * *